US005242004A

United States Patent [19]

Stilling

[11] Patent Number: 5,242,004

[45] Date of Patent: Sep. 7, 1993

[54] AWNING STRUCTURES

[76] Inventor: Johann Stilling, 1141 Royal York Road, Islington, Ontario, Canada, M9A 4A9

[21] Appl. No.: 822,737

[22] Filed: Jan. 21, 1992

[51] Int. Cl.[5] ..... A47H 13/00

[52] U.S. Cl. ..... 160/57; 160/395; 135/117; 52/63

[58] Field of Search ..... 52/63, 74, 201, 656.1, 52/658; 160/57, 58.1, 383, 384, 386, 392, 394, 395, 397, 39; 135/102, 117, 97; 403/401, 402, 297

[56] References Cited

U.S. PATENT DOCUMENTS

| | | | |
|---|---|---|---|
| 3,006,409 | 10/1961 | Pemberton | 160/386 X |
| 4,189,880 | 2/1980 | Ballin | 160/392 X |
| 4,516,343 | 5/1985 | Stilling . | |
| 4,547,987 | 10/1985 | Stilling . | |
| 4,554,754 | 11/1985 | Stilling . | |
| 4,566,236 | 1/1986 | Pound | 52/63 X |
| 4,662,038 | 5/1987 | Walker | 160/392 X |
| 4,682,433 | 7/1987 | Stilling . | |
| 4,690,192 | 9/1987 | Stilling . | |
| 4,817,655 | 4/1989 | Brooks | 160/392 X |
| 4,860,778 | 8/1989 | Pohl | 52/63 X |
| 4,905,390 | 3/1990 | Stilling . | |
| 4,920,714 | 5/1990 | Sease | 160/392 X |
| 4,947,561 | 8/1990 | Delacroix et al. | 160/392 X |
| 5,044,131 | 9/1991 | Fisher | 160/392 X |
| 5,076,033 | 12/1991 | Patsy, Jr. | 160/392 X |

FOREIGN PATENT DOCUMENTS

| | | | |
|---|---|---|---|
| 34703 | 10/1965 | Finland | 160/383 |

*Primary Examiner*—Carl D. Friedman
*Assistant Examiner*—Lan M. Mai

[57] ABSTRACT

An awning structure of the type having a frame work in which some parts are bent into a radius, and a fabric cover secured snugly over the frame, the curved frame parts extending generally between a vertical and a lower portion, and some of the frame parts being of identical cross-section, defining a generally U-shaped channel, with opposed side walls, and a bottom wall joining the side walls, and the side walls defining an open mouth remote from the bottom wall, an intermediate bracing wall extending from the bottom wall between the side walls, the side walls and the intermediate wall lying in planes parallel to one another and spaced apart from one another, and the intermediate wall defining a free edge, terminating substantially adjacent the open mouth, a bridge wall extending between each side wall and the intermediate wall, the bridge wall being spaced inwardly from the open mouth, and defining a generally arch shape in section.

7 Claims, 2 Drawing Sheets

AWNING STRUCTURES

FIELD OF THE INVENTION

The invention relates to awning structures of the type which are used on interior and exterior store fronts, or on the front of retail premises for example in shopping malls, and other large public buildings, but is also a wider application to awnings for any form of use both as sun shades, or as decorations, or simply as signage, whether domestic, or commercial or industrial or otherwise.

BACKGROUND OF THE INVENTION

The use of awnings as store front signs, and also as decoration on store windows, and their use on private dwellings, and on commercial and industrial buildings and public buildings both for decoration and for the exclusion of, and shading from, the sun, is widespread.

In the design of such awning structures numerous different considerations must be accounted for. Thus the awning must have a pleasing aesthetic appearance, and be capable of resisting severe wind and weather conditions in many cases, and must have a lengthy life span.

On the other hand it must be made in a simple manner using a minimum of different components, such that it can readily be assembled with the simplest of hand tools, in order to keep its cost down to a minimum.

In practice, the great majority of such awnings are made up on the basis of some form of framework usually of extruded aluminum, on which is supported some form of fabric covering such as canvas, or vinyl, or nylon coated fabric.

A wide variety of such materials are available, and customers may select one or the other for a variety of reasons, and it is desirable to provide a system accommodating as far as possible relatively wide variations in customer tastes, and budgets.

One usual factor in the design of such awnings which is desired by the great majority of customers, is the fact that the awning should have a convexly curved or contoured exterior shape. Usually, the awning structure will have a flat surface which can be placed substantially vertical on a vertical face of the building, usually just over a window or doorway. Usually, such awnings as are used on store fronts will incorporate some form of electrical receptacles, and lighting tubes, so that illumination can be thrown downwardly from the awning onto the front of the building.

Usually, such awnings will incorporate a bottom frame, with or without a bottom wall, which is generally substantially horizontal although it can be angled at a angle if desired. The bottom frame, or wall, usually (in an illuminated awning) incorporates some form of lens structure for allowing passage of light from the lighting tubes. In the majority of cases the lens structure is simply a grid of for example translucent plastic material, defining a large number of holes, somewhat in the manner of an egg crate divider. However a great many other forms of lens structures in various materials are available.

In other forms of signs, the lens structure may be replaced with panels, which may themselves support lighting fixtures, so that the lighting fixtures can be oriented at desirable angles for various lighting effects.

Usually, the portion of the awning which extends from the top of the vertical portion, to the outwardly extending edge of the horizontal portion, is comprised of a curved shape, in some cases continuously curved, and in other cases being partially curved and partially straight. It may be rounded at each end, or may have planar end panels.

It is usually a requirement that the fabric material of the awning shall be stretched tightly over this curved frame, and shall also be fitted tightly around the ends of the frame, so that at each end, the awning defines substantially vertical end panels which have a vertical side edge, a horizontal side edge, defining a generally L-shape, and a curved contour extending between the free ends of the L-shape.

Thus the piece of fabric at each end of the awning may be cut more or less as it were in the shape of a quarter-round in section, or in a series of arcuate sections or segments, tailored to the desired shape.

While the design of the frame itself to support such a fabric awning does not appear to present serious problems, in practice, the tailoring and fitting of the fabric so that it fits tightly over the frame does present problems. In the past, in the great majority of cases, the fabric has been required to be cut in at least three portions, for example a rectangular portion covering the forwardly extending curved surface of the awning, and two quarter-round portions, filling in each end. The three portions will then be sewn together, and snugly and tightly drawn over the frame.

The skills and techniques required for such cutting and sewing somewhat resemble the skills and techniques required for the accurate fitting of furniture coverings and upholstery materials. It is well known that these skills require many years of practice, and are not easily attained by everyone.

In addition, the requirement for sewing of these materials has meant that the factories where the awnings and signs are being fabricated must be equipped with sewing facilities. These sewing facilities must be capable of sewing heavy duty fabrics, and appropriately trained and skilled personnel must be kept on staff. The fabric used for such signs and awnings is relatively expensive. In addition, it is usually the practice to print some form of message on the front portion of the sign, for example by silk screening. This involves further skills, and increases the cost of the sign.

If there are any errors made in the cutting or sewing of the sign, it may be that all of the fabric must be discarded, and work started again. This means not merely that the cost of the material is a waste but also that the work involved in the silk screening of the sign and the like is also wasted.

For all of these reasons therefore the use of the tailoring and fitting and sewing techniques required in the manufacture of conventional awnings and signs has been regarded with considerable disfavour by the industry.

In the past, various attempts have been made to overcome this. For example, in U.S. Pat. No. 4,690,192 inventor Johann Stilling, for Replaceable Awning, issued Sep. 1, 1987, there was disclosed a form of framework for an awning, wherein the fabric portions of the awning were held in place by a continuous extruded thermoplastic plug member or wedge, by means of which the edge of the fabric was force fitted into a groove in the extrusion and securely held in position. This avoided the requirement for sewing.

Another variation on this technique, was to secure a receiving body in the extrusion and then to take the edge of the fabric and stretch it tightly over the plastic extrusion, and then simply staple through the fabric into the receiving body in plastic extrusion.

This system represented something of an improvement over the conventional sewing and stitching techniques employed in the past. However, certain disadvantages were inherent in the frame design in the aforesaid patent. As mentioned above it is generally desirable that the front of the awning shall be contoured or curved so as to provide as it were a "bonnet" or "umbrella" effect. In order to do this, it is necessary to fabricate a frame for the awning in which a number of the frame members are curved around a predetermined radius of curvature, so as to provide a uniform contour along the length of the sign or awning.

The aforesaid patent discloses a somewhat complex cross-section for its frame extrusion, and this in turn presented somewhat of a challenge from the view point of achieving a satisfactory smooth curve when the extrusion was bent. In practice, specialized bending machinery had to be developed in order to produce satisfactory repeatable curves in this extrusion.

BRIEF SUMMARY OF THE INVENTION

With a view to satisfying the various problems noted above, the invention comprises an awning structure of the type having a framework, comprising a plurality of lengths of frame material, and wherein at least some portions of said framework lengths are bent into a predetermined radius of curvature, and a fabric cover secured snugly over said frame work, and said framework defining at least a generally vertical attachment portion, and a lower portion extending generally outwardly from said vertical attachment portion, and said curved framework portions extending generally between said vertical and said lower portions, and said awning structure comprising, a plurality of said frame portions of identical cross-section, each of said identical cross-section frame portions defining a generally U-shaped channel, having opposed side walls, and a bottom wall joining said side walls, and said side walls defining an open mouth remote from said bottom wall, an intermediate bracing wall extending from said bottom wall between said side walls, said side walls and said intermediate wall lying in planes parallel to one another and spaced apart from one another, and said intermediate wall defining a free edge, terminating substantially adjacent said open mouth defined by said side walls, bridge wall means extending between each said side wall and said intermediate wall, said bridge wall means being spaced inwardly from said open mouth, and defining a generally arch shape in section.

The invention further comprises such awning structure and including retention rib means formed on the free edges of said channel side walls and of said intermediate wall, on opposite sides of said open mouth.

The invention further comprises such an awning structure and wherein said frame means further includes secondary frame pieces, said secondary frame pieces defining a generally channel shape in section having a pair of opposed side walls lying in parallel spaced apart planes, and a bottom wall extending there between, and defining at their free edges an open mouth, and a bracing web extending between said side walls adjacent to but spaced inwardly from said open mouth.

The invention further comprises such an awning and wherein said side walls of said frame pieces have a predetermined thickness wherein said bridge wall means have a thickness less than said predetermined thickness, whereby fastening means may be forced through said bridge wall means, without distortion of said side walls.

The invention further comprises such an awning structure and wherein frame cap members are provided, said frame cap members comprising a continuous wall portion adapted to span said open mouth of said frame portions and close the same, and a pair of engagement means extending inwardly from said continuous wall portion, formed with retention formations, interengagable with said free edge of said intermediate wall of said frame piece, whereby to secure and retain said frame cap members in position on said frame pieces.

The invention further comprises an awning formed of a frame having the foregoing features, and further comprising flexible fabric material extending between said frame pieces, and being secured to at least some of said frame pieces by securement members passing through said fabric, and passing through said bridge members, thereby securing said fabric between said side walls and said intermediate walls of said frame pieces, whereby two adjacent portions of fabric may be secured to the same frame piece, but are separated from one another by said intermediate wall, thereby permitting one said fabric piece to be secured to a said frame piece, and permitting a second fabric piece to be secured to the same said frame piece, in two separate operations, and said frame cap member being secured to said intermediate frame piece, and covering each of said fabric pieces secured to said frame piece.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
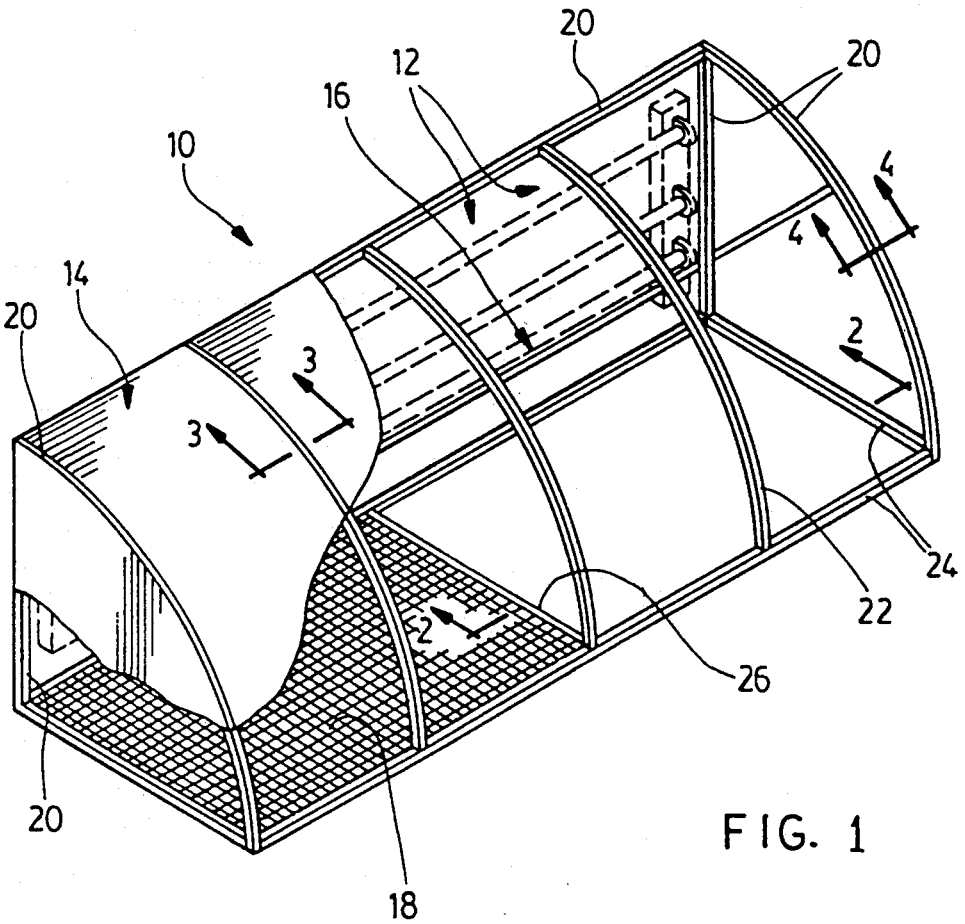
FIG. 1 is a perspective illustration of a typical awning structure in accordance with the invention, partially cut away to reveal its construction.

Referring first of all to FIG. 1 it will be seen that the awning structure to which the invention relates is illustrated generally by the reference 10. Such awning structures are familiar sights as being decorative additions to building exteriors both domestic, commercial, industrial, and of course retail establishment and in interior locations such as malls. In addition, they are well known as providing store front signage, in which case they usually contain illumination typically in the form of fluorescent tubes or the like, and usually having some form of name or insignia silk screened or printed thereon.

In addition, provision may be made for lenses or other structure to permit light to fall from the awning downwardly onto the store front for illumination of the store window and goods displayed therein.

All of this is of course very well known in this art and is mentioned here merely by way of preliminary remarks.

As is shown in FIG. 1, the awning 10 comprises a framework indicated generally as 12, to which is attached a fabric 14. Within the awning frame, illumination 16 is provided, and lenses 18 may be supported to permit light to fall downwardly.

Figure 2:
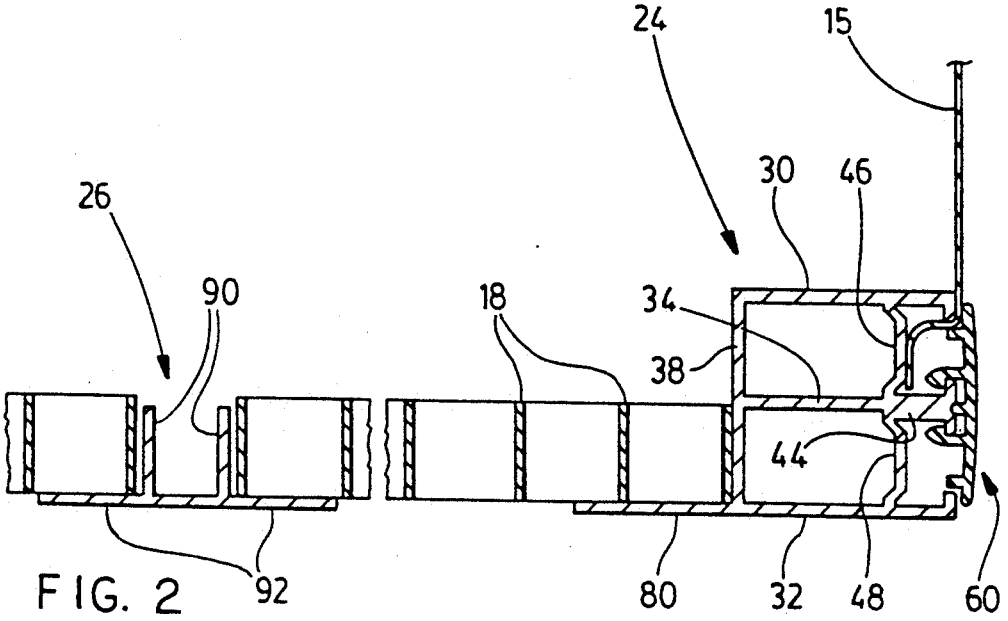
FIG. 2 is an enlarged perspective illustration partially cut away of a frame portion of the awning structure of FIG. 1.
Figure 3:
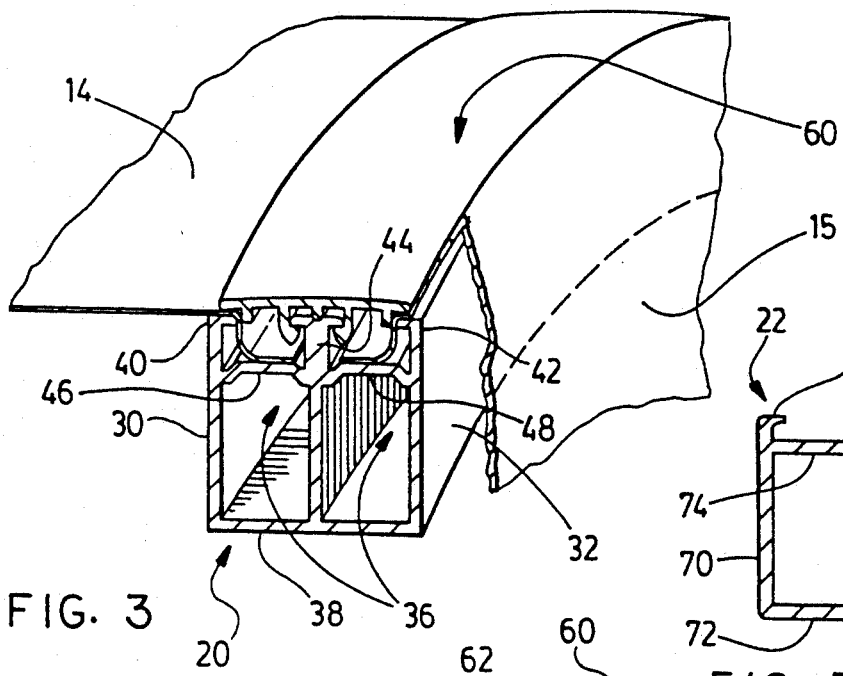
FIG. 3 is a cut away perspective of a frame portion, and, FIG. 4 is a section along the line 4—4 of FIG. 1.
Figure 4:
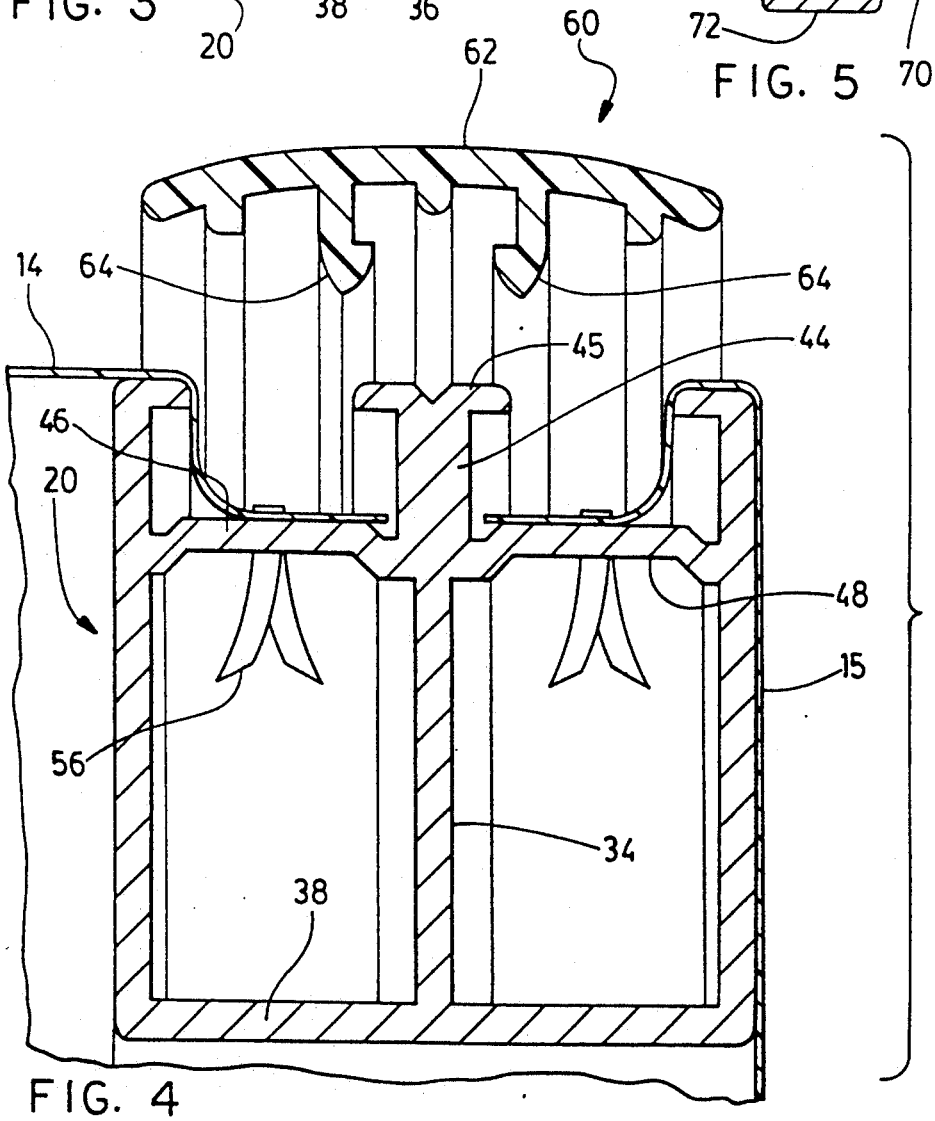

As will be better understood from FIGS. 2, 3, and 4, the frame 12 consists of a plurality of first frame members 20, a plurality of intermediate secondary frame members 22, a plurality of third frame members 24, and fourth frame members 26.

All of the frame members 20, 22, 24, and 26 are formed of extruded aluminum material in this embodiment, and may be joined together by aluminum welding techniques, or by junction devices (not illustrated) such as are well known in the art. In the embodiment as illustrated in FIG. 1 an additional intermediate frame member 26 is also employed, also made of extruded aluminum, for purposes to be described herein.

Referring first of all to FIG. 3, the first frame members 20 will be seen to be formed of generally double parallel channel construction, having opposed outer channel side walls 30 and 32, and an intermediate channel separation wall 34. The walls 30, 32, and 34 are parallel to one another and are spaced apart so as to provide a pair of continuous elongated channels of generally rectangular cross section indicated as 36.

A channel bottom wall 38 joins the adjacent edges of walls 30, 32, and 34.

Channel wall lip portions 40 and 42 define outwardly extending free edges of walls 30 and 32 respectively.

Intermediate wall 34 is also extended as at 44, between side wall lip portions extensions 40 and 42 and has a T-shaped head 45.

In order to secure and anchor edges of the fabric panel 14, bridge wall portions 46 and 48 extend respectively between walls 30 and 34 and walls 34 and 32.

As best shown in FIG. 4, these bridge wall portions 46 and 48 are formed in a generally arch shaped fashion, being defined by respective angled side edge portions 50 and 52, and a central arch portion 54.

It will be noted that walls 30 and 32 are of a predetermined first thickness, and that wall 34 is of a second thickness somewhat less than the thickness of walls 30 and 32.

It will be noted that the bridge walls 46 and 48 are of a thickness substantially less than that of the walls 30 and 32.

In this way they are adapted to receive fastenings such as metal staples 56 (FIG. 3).

Staples 56 are preferably formed of hardened steel, with sharp points, and are inserted by means of a power operated stapling machine, such as are well known in the art, of sufficient power that it can drive the staples 56 through the fabric of the panels 14 and through the arch walls 46, 48.

It will thus be seen that the first frame portions 20 of the invention provide dual spaced apart securement means in the forms of the two arch wall portions 46 and 48, which are separated apart from one another by the upstanding extension portion 44 of the central partition wall 34.

In this way, two edge portions 14*a* and 14*b* of the fabric 14 may be secured to the same frame member 20.

Taking the awning 10 as shown in FIG. 1 as being typical, this means that the front panel of the fabric 14 can simply be cut in the form of a rectangle, and the edges can then simply be secured by stapling directly to one of the bridge walls 46 or 48 in the frame portions 20 at each end of the awning frame.

The end portions 15 of the fabric cover 14 may be cut to fit the shape of the ends of the frame which in this case is in the form of a quarter of a circle, more or less, of and which defines a ninety degree angle in this particular case. The shape may vary depending on the shape of the frame. The edges of these end panels may be secured to the other of the bridge walls 46 or 48 of the same frame portions 20, also by stapling. In this way, the requirement for skilled labour, with sewing and careful tailoring, is reduced to a minimum.

In order to close off the open mouth defined between the channel wall extensions 40 and 42, a cover strip 60 is provided. Strip 60 consists of a continuous elongated strip 62 of thermoplastic material, typically being extruded thermoplastic material, which has engagement means, in the form of two inwardly directed side walls 64—64. Side walls 64—64 define between them a single continuous channel 66. Channel 66 is adapted to fit around and engage the T-shaped head 45 on extension 44 of the intermediate wall 34.

Figure 5:
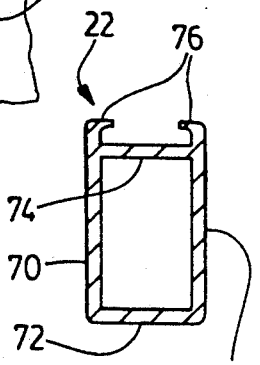

The intermediate frame portions 22 are in this case provided as interior bracing members and are not required, in most cases, to be secured to the fabric 14 itself. Consequently, they are comprised of single channel structures (FIG. 5) having side walls 70—70 a bottom wall 72 and a top wall 74.

The free edges 76—76 of the walls 70 extend clear of the top wall 74 and provide a channel, which may assist in securing the framework together, or for any other advantageous purpose.

The lower third frame portions 24 will be seen to be of a construction substantially identical to the first frame portions 20, with the exception that in addition to all of the features described in association with the members 20 (FIG. 3 and 4) there is also provided a laterally extending lens support wall 80.

The fourth frame member 26 (FIG. 2) which may not always be required, depending upon the size or length of the awning 10, comprises a pair of upstanding channel walls 90—90, and transverse laterally extending support walls 92 on either side. In this way, edge support for the lens 18 is provided on both sides of the member 26.

This may be necessary in certain circumstances, due to limitations on the length of pieces of the lens 18 either due to manufacturing considerations, or due to its requirement for additional support, and other factors that may have to be taken into consideration.

As mentioned above, in some cases the illumination sources may be, for example individual spot lights (not shown). In this case the lens would be replaced by a support panel (not shown) and the spot lights would be mounted in or on such a panel.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An awning structure of the type having a frame work, comprising a plurality of lengths of frame material, and wherein at least some of said lengths are formed into a predetermined awning shape, and a fabric cover secured snugly over said frame work, and said framework defining at least a generally vertical attachment portion, and a generally lower portion extending outwardly from said vertical attachment portion, and said awning shape frame portions extending generally between said vertical and said lower portions, and said awning structure comprising;

a plurality of said frame portions of identical cross-section, each of said identical cross-section frame portions defining a generally U-shaped channel, having opposed side walls, and a bottom wall joining said side walls, and said side walls defining an open mouth remote from said bottom wall;

an intermediate wall extending from said bottom wall between said side walls, said side walls and said intermediate wall lying in planes parallel to one another and spaced apart from one another; and, bridge wall means extending between each said side wall and said intermediate wall, said bridge wall means being spaced inwardly from said open mouth, and defining a generally arch shape in section.

2. An awning structure as claimed in claim 1 including retention means formed said intermediate wall.

3. An awning structure as claimed in claim 1 and wherein said frame means further includes secondary frame pieces, said secondary frame pieces defining a generally channel shape in section having a pair of opposed side walls lying in parallel spaced apart planes, and a bottom wall extending therebetween, and defining at their free edges an open mouth, and a bracing web extending between said side walls adjacent to but spaced inwardly from said open mouth.

4. An awning structure as claimed in claim 1 wherein said side walls of said frame pieces have a predetermined thickness, and wherein said bridge wall means has a thickness less than predetermined thickness, whereby fastening means may be forced through said bridge wall means, without distortion of said side walls.

5. An awning structure as claimed in claim 1 and wherein frame cap members are provided, said frame cap members comprising a continuous wall portion adapted to span said open mouth of channel side walls of said frame pieces and close the same, and means portions extending inwardly from said wall portion, said finger means being spaced apart a predetermined distance, and being interengagable with said free edge of said intermediate wall of said frame piece, whereby to secure and retain said frame cap members in position on said frame pieces.

6. An awning structure as claimed in claim 1, and further comprising flexible fabric material extending between said frame pieces, and being secured to at least some of said frame pieces by securement members passing through said fabric material, and passing through some of said bridge wall means, thereby securing edges of said fabric material between said side walls and said intermediate walls of said frame pieces, whereby two adjacent portions of fabric may be secured to the same said frame piece, but are separated from one another by said intermediate wall, thereby permitting an edge of one said fabric piece to be secured to a said frame piece on one side of said intermediate wall, and permitting an edge of a second fabric piece to be secured to the same said frame piece on the other side of said intermediate wall, in two separate operations, and said frame cap member being secured to said intermediate frame wall, and covering each of the edges of each of said fabric pieces secured to said frame piece.

7. An awning structure as claim in claim 1, and including further said frame pieces forming said lower portion, and support wall means formed on said further frame pieces for supporting panel means thereon.

* * * * *